United States Patent [19]

Biehl et al.

[11] Patent Number: 4,875,531

[45] Date of Patent: Oct. 24, 1989

[54] CORE DRILLING TOOL WITH DIRECT DRIVE

[75] Inventors: Johann Biehl, Kirchheim/Teck; Alfred Ostertag, Celle, both of Fed. Rep. of Germany

[73] Assignee: Eastman Christensen Company, Salt Lake City, Utah

[21] Appl. No.: 148,676

[22] Filed: Jan. 25, 1988

[30] Foreign Application Priority Data

Jan. 23, 1987 [DE] Fed. Rep. of Germany ..... 3701914

[51] Int. Cl.[4] ..... E21B 25/02

[52] U.S. Cl. ..... 175/250; 175/107

[58] Field of Search ..... 175/58, 246, 244, 248, 175/249, 250, 251, 252, 107; 73/864.43, 864.44

[56] References Cited

U.S. PATENT DOCUMENTS

| | | | |
|---|---|---|---|
| 2,898,086 | 8/1959 | Freeman, Jr. et al. | 175/58 |
| 2,915,285 | 12/1959 | Deily | 175/246 X |
| 4,518,050 | 5/1985 | Sollie et al. | 175/250 |
| 4,518,051 | 5/1985 | Sollie et al. | 175/250 |

*Primary Examiner*—Stephen J. Novosad
*Assistant Examiner*—David J. Bagnell
*Attorney, Agent, or Firm*—Arnold, White & Durkee

[57] ABSTRACT

A core drilling tool with direct drive consisting of an outer pipe that can be connected to a drilling shaft, a core drilling appliance reciprocally mountable in the outer pipe which in turn includes a core barrel that carries a drill bit and an inner pipe mounted in rotatable relation therewith and for reciprocal movement therewith, and a drilling mud driven motor that is integrally coupled to the core drilling appliance and is secured against rotation in the outer pipe and having reaction faces that are put under pressure to produce a downward axial feed force acting on both the core drilling appliance and the motor, plus a capture device for pulling up the motor together with the core drilling appliance. In order to produce a sufficiently great axial feed force of an adjustable size that is essentially independent of the exposure of the core drilling appliance, the motor is connected to the core drilling appliance to form a common movable unit and devices are provided for adjusting the axial feed force.

8 Claims, 4 Drawing Sheets

CORE DRILLING TOOL WITH DIRECT DRIVE

BACKGROUND OF THE INVENTION

This invention concerns a core drilling tool with direct drive.

Such tools can be used for core drilling jobs in all conventional deep well drilling installations. It is not necessary to dismantle the entire drilling shaft in order to remove the core.

U.S. Pat. No. 4,518,050 describes a core drilling tool of the type defined initially which makes it possible to pull the core drilling appliance while the outer pipe remains in the borehole and whereby the core drilling appliance can be moved axially in the outer pipe during coring. The motor of this tool remains axially secured in the outer tube during coring and is rotationally coupled to the movable core drilling appliance by way of movable coupling elements. The core drilling appliance presents reaction faces to the drilling fluid such that they impose an axial feed force on it as a result of the drilling fluid pressure applied to it in combination with the extent of the surfaces. The drilling mud pressure applied through the core drilling appliance is caused by the throttling effect of the annular spaces and gaps in the drilling mud flowing through the core drilling appliance. A first space through which the flow passes is formed by a core pipe and an inside pipe that carries a drill crown. A second space through which flow passes is located between the above-mentioned inside pipe and an outer core barrel surrounding it.

Although the throttling effect of the first space remains constant, the throttling effect of the second space decreases with an increase in exposure of the core drilling appliance out of the outer core barrel. The drilling mud pressure and thus the axial feed force are proportional to the sum of the throttling effects of the two spaces. In addition to the great dependence of the axial feed force on the exposure of the core drilling appliance, another disadvantage is that the maximum value of the axial feed force is relatively low and furthermore the size of this force cannot be influenced.

SUMMARY OF THE INVENTION

The problem on which this invention is based is to improve a direct drive core drilling tool in such a way that a sufficiently large axial feed force that is essentially independent of the exposure of the core drilling appliance and can be adjusted in size can be applied to the core drilling appliance.

This problem is solved with a direct drive core drilling tool wherein the mud motor is integrally connected to the core drilling appliance.

By combining the core drilling appliance with the motor to form a common movable unit, it is also possible to utilize the much higher drilling mud pressure that is applied over the motor for production of an axial feed force. Since this pressure is independent of the exposure of the core drilling appliance, the exposure-dependent influences on the total drilling mud pressure applied over the unit are reduced. With devices for adjusting the axial feed force, this can also be adapted to other operating conditions such as a different mud weight or a different drill crown. This invention thus permits universal usability of the tool without inadvertent overloading of the motor and thus achieves optimum drilling advances.

BRIEF DESCRIPTION OF THE DRAWINGS

The figures illustrate practical examples of this invention as explained below. They show.

Figure 1:
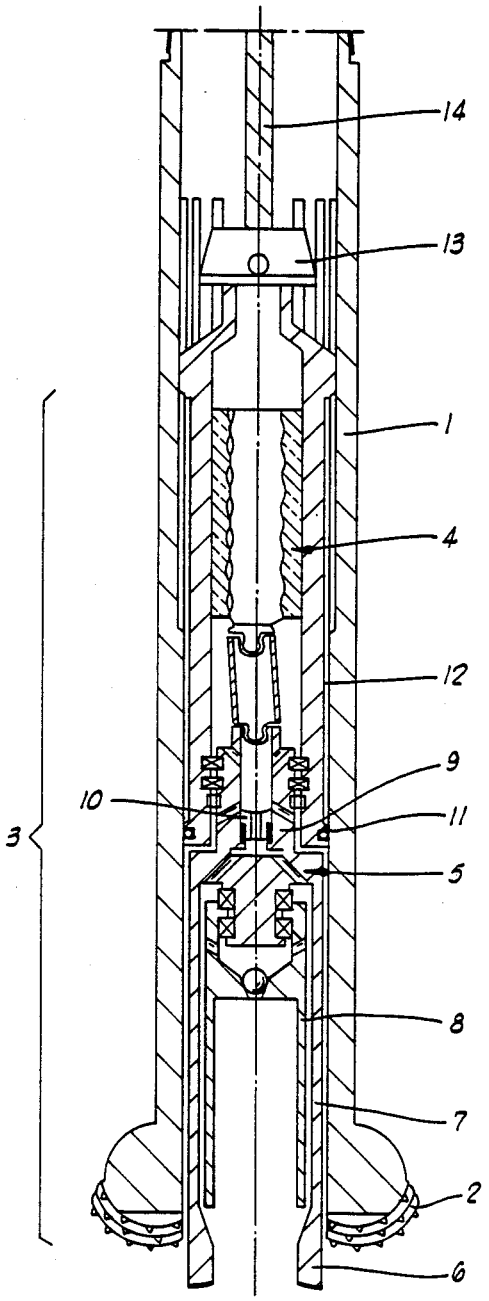
FIG. 1 shows a schematic longitudinal section through a core drilling tool according to this invention.

The core drilling tool illustrated in FIG. 1 has an outer pipe 1 that can be connected to a drilling shaft (not shown). A roller bit 2 is mounted on the lower end and serves to bore open an annular space and reset outer pipe 1 when the exposure area of the core pipe is exhausted. Inside the outer pipe 1, there is a unit 3 consisting of a motor 4 and a core drilling appliance 5. This unit 3 can be moved axially. Although motor 4 is secured to prevent it from rotating, core drilling appliance 5 is mounted so it can rotate. Core drilling appliance 5 itself comprises a core barrel 7 that carries a drill bit 6 and an inner pipe 8 mounted within said core barrel for reciprocal movement therewith and in rotatable relation therewith. Between motor 4 and core drilling appliance 5, there is a drilling mud divider 9 that divides drilling mud coming from motor 4 into a first stream that flows between the outer pipe 1 and core barrel 7 and another stream between core barrel 7 and inside pipe 8. The stream flowing between outer pipe 1 and core barrel 7 is controlled by a spring loaded valve 10 in such a way that it remains uniform despite a decrease in the throttling effect of the flow path due to increasing exposure of core drilling appliance 5.

In order to prevent unwanted bypassing of motor 4 by the drilling mud, motor 4 is provided with a collar 11 that fills the annular space between its casing and the outer pipe 1. The collar 11 is sealed with respect to outer pipe 1 and together with other casing areas of motor 4 forms partial faces that fill out the cross-sectional area of an inner passage area 12 of the outer pipe 1. These partial faces yield the reaction faces of the drilling mud pressure applied over unit 3 and create the axial feed force for unit 3.

In the upper area of motor 4, there is a capture device 13 that serves to pull out the entire unit 3 after boring a core. Capture device 13 in the first version according to this invention serves as a device for adjusting the axial feed force by opposing core drilling appliance 5 with a restraining force that is supplied to it over a cable 14 leading through the drilling strand by means of a winch on the drilling tower. Depending on the size of the restraining force, values between a maximum value and zero can be adjusted for the resultant axial feed force. The maximum value is obtained when the full extent of the axial feed force is determined by the drilling mud pressure applied over unit 3 in combination with the reaction faces.

Figure 2:
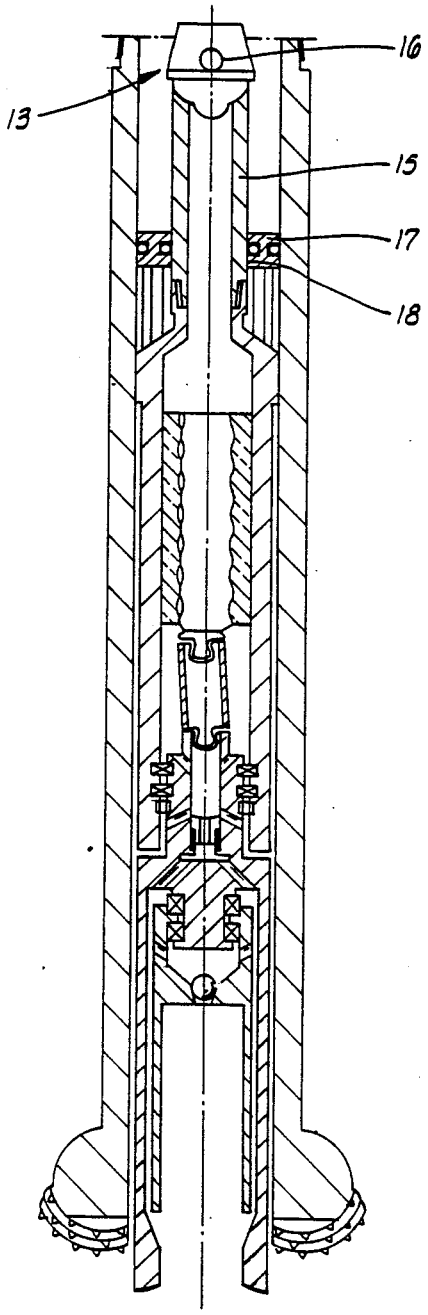
FIG. 2 shows a first modification of this invention as a detail from FIG. 1.

In the modified version shown in FIG. 2, the reaction faces that are exposed to the pressure are designed as the cross-sectional area of a drilling mud mandrel 15 connected to the motor. The mandrel provided for the capture device 13 is used for the mud mandrel 15 but it is designed so it is hollow on the inside and has inlet orifices 16. The devices for adjusting the axial feed force inside a sleeve 17 that is mounted and sealed in outer tube 1, has an opening 18 and has mud mandrel 15 passing through it.

Mud mandrel 15 is sealed against sleeve 17. The axial feed force is adjusted by the fact that a sleeve 17 with a certain cross section of opening 18 as well as a mandrel 15 coordinated with it are selected and premounted before inserting unit 3 into outer pipe 1.

Figure 3:
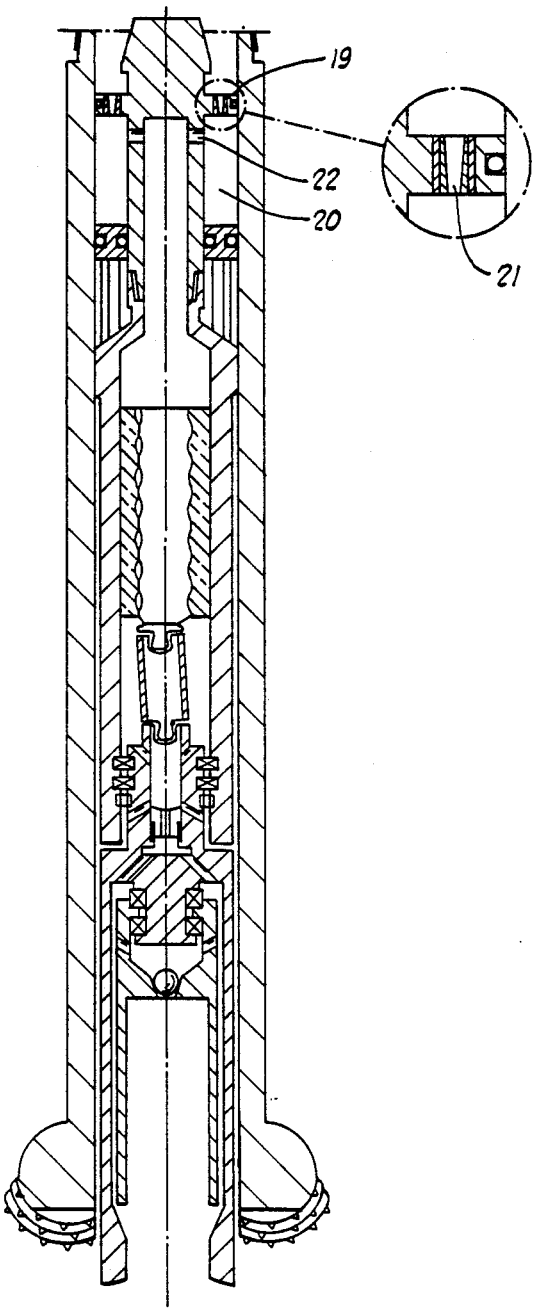
FIG. 3 shows a second modification of this invention.

The modification of the core drilling tool according to this invention shown in FIG. 3 is based on the version according to FIG. 2. In addition to the devices already mentioned there are adjusting the axial feed force, mud mandrel 15 also has a plunger 19 that has the cross-sectional area of another passage region 20 and contains nozzles 21. The inlet orifices 22 of mud mandrel 15 are located beneath plunger 19 in the form of radial slits. Plunger 19 creates an additional part of the axial feed force by utilizing the differential pressure applied through nozzles 21. This differential pressure acts on the cross-sectional area of the inner passage region 20 of outer tube 1 taken up by plunger 19 minus the nozzle cross section. The additional part of the axial feed force is adjustable through the choice of nozzles 21 as well as the volume flow of the drilling mud. The advantage of this version is that a set of nozzles 21 of different sizes is less expensive than a set of mud mandrels 15 and sleeves 17 of different sizes as required in the version according to FIG. 2, and the time required for the exchange is also less.

Figure 4:
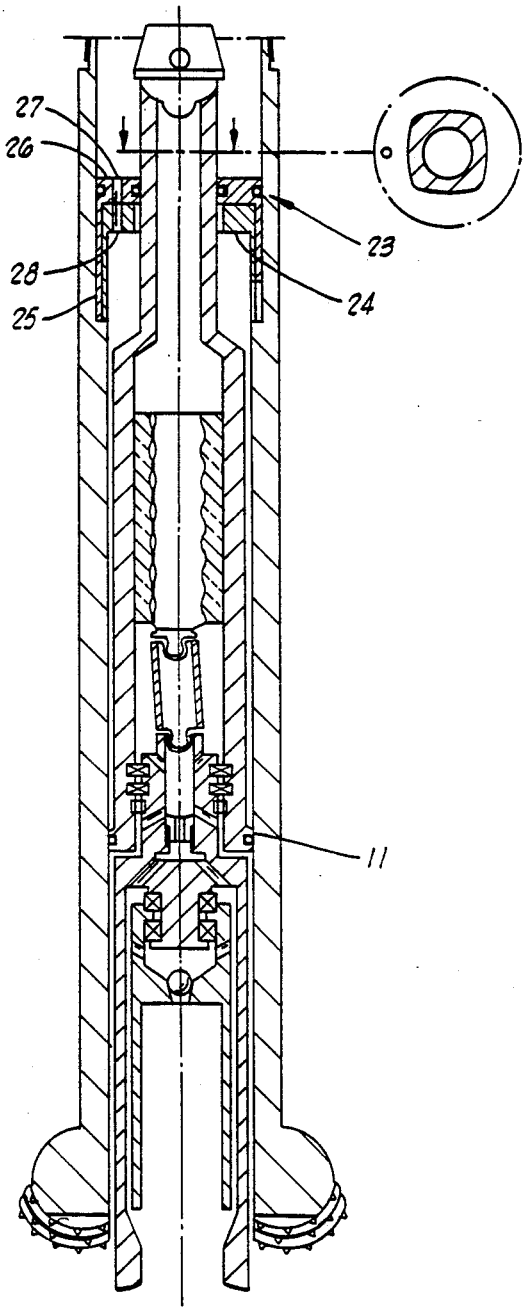
FIG. 4 shows a third modification of this invention.

Finally, FIG. 4 shows a third modification of this invention, whereby the means for adjusting the axial feed force are formed by a valve 23 controlled by the reverse torque of motor 4. This valve 23 consists specifically of a stationary valve seat 24 and a valve body 26 that is coupled to the motor casing and can pivot to a limited extent against a torque spring 25. Again the same partial faces as those mentioned in the version according to FIG. 1 serve as the reaction faces for the axial feed force.

In the unloaded states, i.e., when motor 4 does not apply any reverse torque, the orifices 27, 28 of valve body 26 and valve seat 24 are aligned. The drilling mud can then penetrate into the area of collar 11 and put the entire partial area of motor 4 under pressure. Then when core drilling appliance 5 is pressed against the rock by the axial feed force, the motor 4 must overcome the drilling torque of drill bit 6 so it experiences a reverse torque. This reverse torque directed against the force of spring 25 causes motor 4 and thus valve body 26 to be pushed against valve seat 24 to get partially or entirely out of alignment. Then the drilling mud pressure cannot propagate into the area of collar 11 to the full extent or not at all and is applied only to the partial faces of the motor casing that have a small cross section. Thus there is a reduction in the axial feed force. In steady-state operation, an angle position will result between valve body 26 and valve seat 24 in which the torque of drill bit 6 and the axial feed force which is associated with it assume an equilibrium state. The third modification of this invention thus offers the possibility of automatic adjustment even within a large volume flow range and pressure range of the drilling mud.

What is claimed is:

1. A direct drive core drilling tool comprising:

an outer pipe adapted at its upper end to be connected to a drilling shaft;

a core drilling appliance reciprocally mountable within said outer pipe, said core drilling appliance comprising:

(a) a core barrel adapted at its lower end to carry a drill bit, and (b) an inner pipe mounted within said core barrel for reciprocal movement therewith and in rotatable relation therewith, and adapted at its lower end to receive a core entering the core barrel; and a mud motor positionable within the outer pipe in an axially moveable relation, said mud motor coupled to the upper end of the core barrel to rotate the core barrel, and operable in response to drilling fluid, or mud, passed down through the drill shaft and into the core drilling appliance;

said mud motor and said core drilling appliance each comprising reaction faces responsive to liquid pressure to produce a downward axial feed force acting on both the motor and the core drilling appliance.

2. The direct drive core drilling tool of claim 1 further comprising means for adjusting the axial feed force acting upon at least one of said motor and said core drilling appliance.

3. The direct drive core drilling tool of claim 2 wherein said ajusting means comprises:

mud divider means for dividing the mud coming from said motor into a first stream flowing in a first annular space between said outer pipe and said core barrel and a second stream flowing in a second annular space between said core barrel and said inner pipe;

a flow control valve interposed between the mud divider means and said first annular space operable to maintain the mud stream flowing to said first annular space generally uniform; and seal means for blocking the mud flow from entering an annular space between an outer casing of the motor and the outer pipe.

4. The direct drive core drilling tool of claim 2, wherein the reaction faces that can be exposed to pressure are designed as partial faces of said motor which at least partially occupy the cross-sectional area of an inner passage region of said outer pipe.

5. The direct drive core drilling tool of claim 2, further comprising a capture device, and wherein said means for adjusting the axial feed force comprises said capture device to which a restoring force may be applied by means of a cable leading through the drilling shaft to the surface.

6. The direct drive core drilling tool of claim 5, wherein said means for adjusting the axial feed force further comprises a plunger mounted on a mud mandrel connected to the motor and occupying the cross-sectional area of another inner passage region of said outer pipe, said plunger having a nozzle.

7. The direct drive core drilling tool of claim 2, wherein said means for adjusting said axial feed force comprises a sleeve mounted and sealed in said outer pipe and provided with an orifice wherein the orifice has a mud mandrel passing through it and is sealed, said orifice and said mandrel cooperatively conformed such that the common cross-sectional area of the orifice and the mud mandrel provides a preselected distribution of the drilling mud pressure applied over the unit comprising said motor and said core drilling appliance.

8. The direct drive core drilling tool of claim 2 wherein said adjusting means further comprises:

mud divider means for dividing the mud coming from said motor into a first stream flowing in a first annular space between said outer pipe and said core barrel and a second stream flowing in a second annular space between said core barrel and said inner pipe;

a flow control valve interposed between the mud divider means and said first annular space operable to maintain the mud stream flowing to said first annular space generally uniform; and seal means positionable for blocking the mud flow from entering an annular space between a mud mandrel connected to the motor and the outer pipe.

* * * * *